US007014188B2

(12) United States Patent
Polidoro et al.

(10) Patent No.: US 7,014,188 B2
(45) Date of Patent: Mar. 21, 2006

(54) BANKNOTE STORE

(75) Inventors: Roberto Polidoro, Geneva (CH); Jerome Daout, Geneva (CH)

(73) Assignee: Mars Incorporated, McLean, VA (US)

( * ) Notice: Subject to any disclaimer, the term of this patent is extended or adjusted under 35 U.S.C. 154(b) by 534 days.

(21) Appl. No.: 10/326,229

(22) Filed: Dec. 19, 2002

(65) Prior Publication Data

US 2003/0155704 A1 Aug. 21, 2003

(30) Foreign Application Priority Data

Dec. 20, 2001 (EP) ..... 01310717

(51) Int. Cl.
*B65H 29/26* (2006.01)
*B65H 5/28* (2006.01)

(52) U.S. Cl. ..... 271/216

(58) Field of Classification Search ..... None
See application file for complete search history.

(56) References Cited

U.S. PATENT DOCUMENTS

| | | | | |
|---|---|---|---|---|
| 2,996,264 A | | 8/1961 | Bygdnes | |
| 3,252,669 A | | 5/1966 | Geri | |
| 3,528,627 A | | 9/1970 | Sindlinger | |
| 3,716,205 A | | 2/1973 | Geuder | |
| 4,145,016 A | | 3/1979 | Wiig | |
| 4,871,125 A | | 10/1989 | Haueter | |
| 5,622,027 A | | 4/1997 | Staub et al. | |
| 6,715,753 B1 | * | 4/2004 | Conca et al. | 271/216 |
| 2002/0060413 A1 | * | 5/2002 | Sato et al. | 271/216 |

FOREIGN PATENT DOCUMENTS

| | | | |
|---|---|---|---|
| CH | 667 635 A5 | * | 10/1988 |
| EP | 0290731 | | 11/1988 |
| FR | 1109055 | | 1/1956 |
| JP | 08067382 | | 3/1996 |
| WO | WO 01/36309 | * | 5/2001 |

* cited by examiner

*Primary Examiner*—Donald P. Walsh
*Assistant Examiner*—Kenneth W Bower
(74) *Attorney, Agent, or Firm*—Fish & Richardson PC

(57) ABSTRACT

A banknote store (10, 12, 14, 16) comprises first and second drums (18, 20; 18, 22) mounted for rotation about respective axes on, respectively, first and second shafts (51), an elongate support strip (24; 26) which can be unwound from one of the drums onto the other of the drum, and vice versa, such that banknotes (60) can be supported in succession by the support strip while that is wound around at least one of the drums, coupling means (44, 46, 50) for coupling the shafts together, first biasing means (54) between the coupling means and the first drum and second biasing means (56; 58) between the coupling means and the second drum for allowing biased relative motion between each said drum and said coupling means, and for maintaining tension in the support strip.

9 Claims, 2 Drawing Sheets

BANKNOTE STORE

BACKGROUND OF THE INVENTION

The invention relates to the storage of banknotes or other sheets of value, which are herein referred to simply as banknotes.

It is known hereto to provide a banknote store comprising first and second drums with a strip wound onto both drums and arranged to support banknotes disposed in succession between windings of the strip on the first drum. The strip is wound from the first drum to the second drum to expose successive supported banknotes for removal and is wound from the second drum to the first drum to enable banknotes to be deposited successively on the first drum. The second drum is driven to rotate to wind the strip from the first to the second drum while the first drum may be driven to follow the second drum. In the opposite direction, the first drum is driven to rotate to wind the strip from the second to the first drum while the second drum may be driven to follow the first drum. It is known for the first and the second drums to be fixed for rotation relative to respective shafts which are themselves driven by one or more motors.

When the strip is wound from one to the other drum, it important for the strip to be held firmly between the two drums at all times. As banknotes are stored in discrete locations relative to the strip, movement of the strip would mean that the control arrangement of the banknote store would not be able to locate the exact position of individual banknotes.

During operation, as the number of windings decreases on one drum, the length of strip unwound therefrom also decreases, provided the rotational speed of the drum remains constant. The same is true in reverse. That is, as the number of windings on the other drum increases, the length of strip being wound onto the other drum increases, again, provided the rotational speed of the drum remains constant. This is because the length of strip wound onto or unwound from a drum is dependent on the circumference of the outer winding on the drum. In the prior art, the strip may be held firmly between the drums, by winding the strip onto one drum by rotating that drum, whilst providing some resistance to rotation of the other drum, from which the strip is being unwound. This arrangement enables the strip to be held firmly only when the drums are rotating but may not when the drums are stationary.

In an alternative prior art arrangement, the drums are rotated at varying speeds. In this way, as the strip is unwound from one drum, the drum may be rotated gradually more quickly, because the length of strip being unwound from it per revolution gradually decreases. The reverse is true for the other drum, which may be rotated gradually more slowly as the length of strip being wound onto it per revolution gradually increases. The continuous adjustment of the rotational speeds of the drums requires relatively complicated and expensive arrangements and control of the motor or motors driving the shafts.

It is an object of the present invention to eliminate or, at least, to mitigate the above mentioned problems.

Aspects of the invention are set out in the accompanying claims.

BRIEF DESCRIPTION OF THE DRAWINGS

In order that the present invention may be well understood, an embodiment thereof, which is given by way of example only, will now be described with reference to the accompanying drawings, in which.

DETAILED DESCRIPTION

Figure 1:
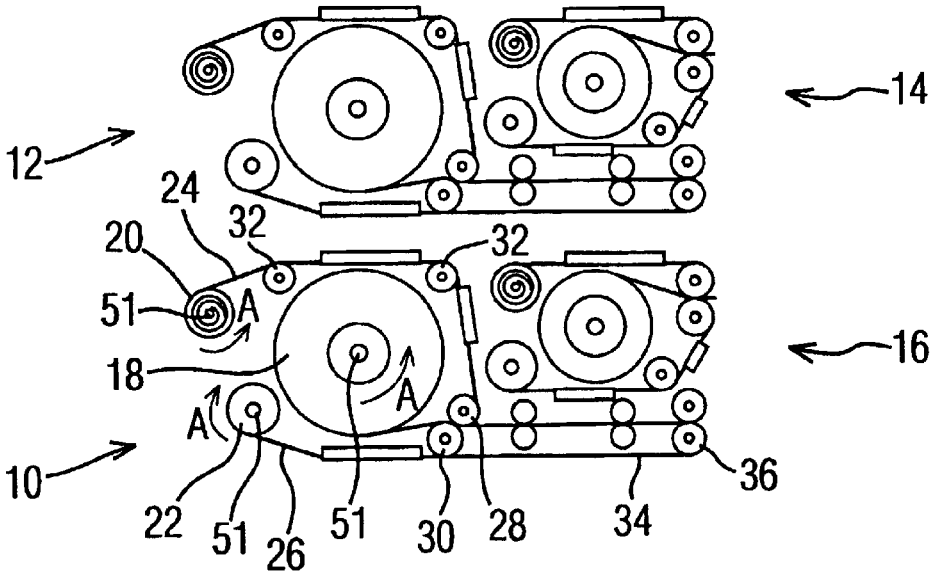
FIG. 1 is a side view of a set of four banknote stores in accordance with the invention.

Referring to FIG. 1, four banknote stores 10, 12, 14, 16 are shown. Such banknote stores may make up component features of a banknote receiving and dispensing machine. Since the stores are very similar, specific reference herein will be made only to store 10.

Store 10 comprises a first, or storage, winding means and two second, or supply, winding means. The first winding means may take the form of a storage drum 18 and the second winding means may take the form of supply drums 20, 22. Other types of winding means may be used as appropriate. The storage drum has wound around it a pair of strips 24, 26 which extend away from the storage drum to rollers 28, 30. The strips then separate, with one strip extending around roller 28 to supply drum 20, and the other strip 26 extending around roller 30 to supply drum 22. Between roller 28 and supply drum 20, strip 24 is guided by additional rollers 32. The strips are one example of elongate support members but other examples may be used instead.

If the storage drum 18 and the supply drums 20, 22 rotate in the directions indicated by the arrows A, the strips 24, 26 are unwound from the storage drum and onto respective supply drums 20, 22. The storage drum 18 and the supply drums 20, 22 can alternatively rotate in the opposite directions so that the strips are unwound from the supply drums onto the storage drum.

Banknotes (60, see FIG. 2) can be fed between the strips 24, 26 as they come together at rollers 28, 30, when the strips are being wound onto the storage drum 18. Thus, individual banknotes can be stored in a spiral arrangement on the storage drum, in successive positions between strips 24, 26. In the view shown in FIG. 1, an endless belt or strip 34 and series of rollers 36 can be used to guide the banknote from one position relative to the banknote store 10 to be taken up between strips 24, 26. Thus, assuming that the strips 24, 26 are being unwound from the storage drum (drums rotated in direction A), any banknotes held thereby will be delivered to belt 34 to be guided to an appropriate position, for instance in a banknote receiving and dispensing machine. Conversely, a banknote introduced to such a machine may be guided to a position between rollers 28, 30 whilst strips 24, 26 are being wound onto storage drum 18 (drums rotated in opposite direction to A). The banknote becomes gripped between the strips 24, 26 as they converge at rollers 28, 30, the banknote then being transported to the storage drum.

Figure 2:
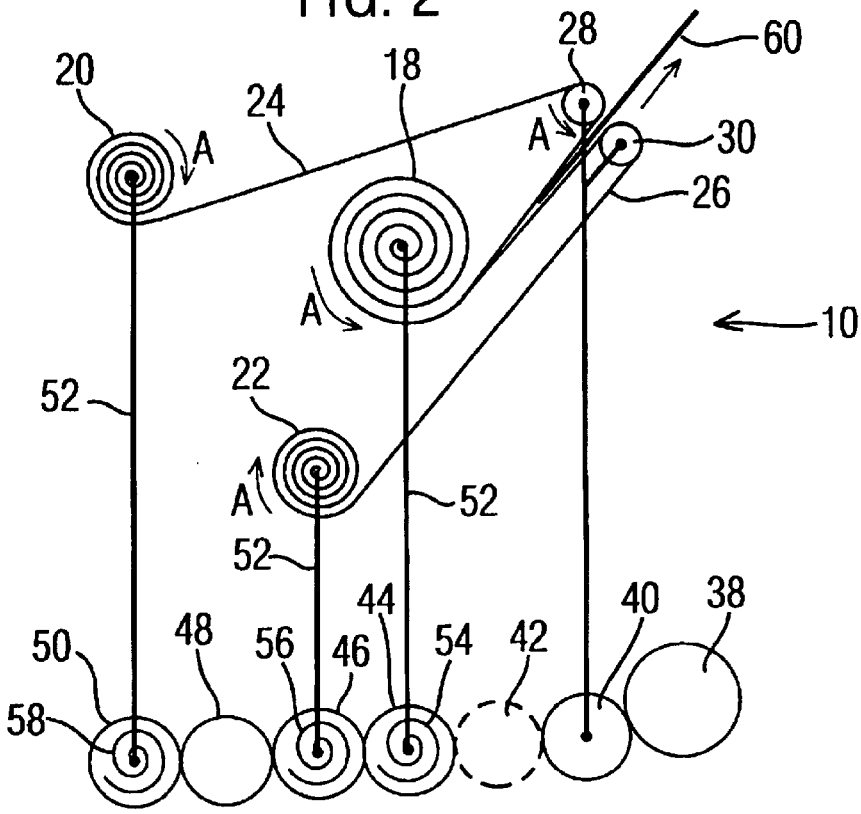
FIG. 2 is a schematic view illustrating the principle of operation of each banknote store.

Referring to FIG. 2, a motor 38 is used for driving, via a gear 40, the shafts of the rollers 28 and 30 to transport the strips 24, 26 at a constant speed in either of two opposite directions.

Gears 44, 46 and 50 are coupled to shafts 51 (see FIG. 1) of storage drum 18 and supply drums 22 and 20, respectively, as shown schematically by lines 52 in FIG. 2. These gears interengage such that they rotate together, in this case by interengaging storage drum gear 44 with first supply drum gear 46, and first supply drum gear 46 with second supply drum gear 50 via an idler gear 48. (In FIG. 2, the arrangement differs slightly from FIG. 1, in that the supply drums rotate in the same direction, so the idler gear 48 is provided between gears 46 and 50 to achieve this.)

Biasing means in the form of spiral or torsional springs 54, 56, 58 connect the shafts to the respective gears 44, 46, 50. The springs allow biased relative rotational movement between each drum and its gear. In this way, strips 24, 26 wound around the drums can be held tightly at all times. The springs are biased in directions which tend to cause winding of the strips onto the respective drums, which also keeps the strips under tension. The use of springs or other biasing means provides a relatively compact and low cost solution. A similar effect can be achieved by alternatively providing the springs between the shafts and the drums, in which case, if the shafts extend through the drums the springs may be provided between the shafts and a radially inwardly facing surface of the respective drum.

Figure 3:
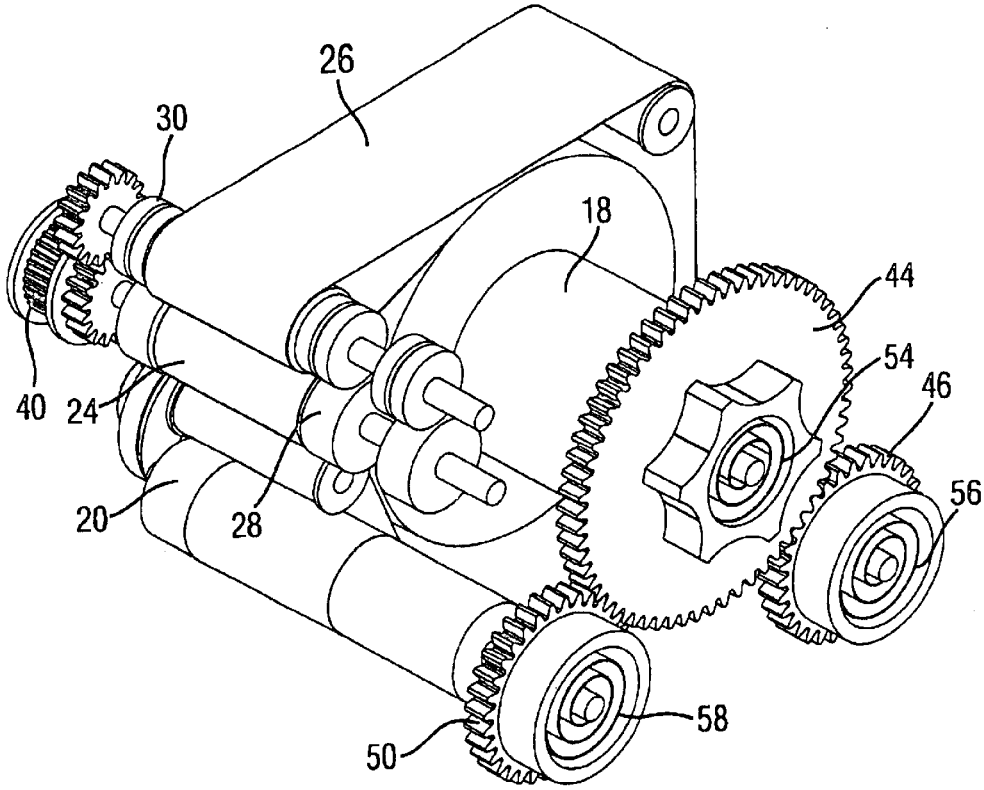
FIG. 3 shows a slightly modified version of one of the banknote stores of FIG. 1.

A practical arrangement is shown in FIG. 3, in which like reference numbers represent like integers. The store of FIG. 3 is similar to those of FIGS. 1 and 2 except for a re-arrangement of the relative positions of the drums, rollers and gears. In this case, the gear 44 for the drum 18 engages each of the gears 46 and 50 for the supply drums 22 and 20, respectively.

The various versions of the banknote store operate as follows.

The rollers 28 and 30 are driven at a constant speed, which determines the speed at which the strips 24, 26 travel. The peripheral speeds of the drums will match the speed at which the tape is fed to or from the drums. Generally speaking, this means that the drums will rotate at a different speed from their associated gears, whose relative speeds will be governed by the gear ratios. This is permitted by the contraction and expansion of the respective springs 54, 56 and 58.

In the preferred embodiment, the gear ratios are set so that, for each drum, when the drum is halfway between its empty and full state, the rotational speed of the driving gear matches the rotational speed of the drum, as determined by the speed of movement of the strips 24, 26. Appropriate gear ratios can be determined from the diameters of the half-wound drums.

In such an arrangement, the spring for each drum has its minimum tension when the drum is half full, although this tension is still significant because the spring is pre-loaded during assembly.

If the drum is less than half full, the periphery will be relatively small so that the drum should rotate faster than the gear. Thus, if the strip is being unwound, the speed of the strip rotates the drum relative to its associated gear, resulting in tensioning of the spring. On the other hand, if the strip is being wound on to the drum, the relatively fast feeding of the strip to the drum means that the spring is allowed to relax, causing an increased peripheral speed of the drum.

Conversely, if the drum is more than half full, the diameter of the drum including the strip wound thereon will be relatively large, and therefore the drum should rotate relatively slowly. The tension in the strip will slow down the drum relative to the driving gear, causing the spring to become gradually tighter, if the strip is being wound on the drum. If it is being unwound, the spring is able to relax, as the drum rotates relative to its associated gear, resulting in the drum rotating slower than the gear.

The result is that, for each drum, as the drum rotates to permit the strip to be unwound from the full state to the empty state, the tension in the spring first decreases to a minimum and then increases again. Similarly, when winding the strip on to the drum, the tension in the spring decreases to a minimum before rising again.

This arrangement has significant benefits. First, it means that the range of tension in each spring is relatively small, thus making it easier to select a suitable spring and to manufacture the assembly, and reducing the range of tensions applied to the strips. Second, the changes in tension within the springs for the supply drums 20, 22 occur at substantially the same time as corresponding changes in tension in the spring for the main drum 18. This balances the tension on both sides of the roller 28, thus reducing the risks of the strips 24, 26 slipping. Preferably, the assembly is designed so that the tensions produced by the springs change in synchronism in a balanced manner even though this may mean that the minimum tension does not necessarily occur when the respective drum is exactly half full.

Although this is the preferred arrangement, alternatives are possible. For example, the gear ratios could be selected so that the speed of rotation of the drum matches that of the associated gear when the drum is fully wound (or fully unwound), in which case the tension in the spring will monotonically change as the drum is fully unwound (or wound).

One advantage of the above-described arrangement is that the speed of movement of the strips 24, 26 remains constant throughout the operation, so that the operation of the storage apparatus can be synchronised to the rest of the host machine in which it is installed, and, if desired, the same motor can be used to drive both the storage apparatus and other parts of the machine. If desired, additional means may be provided to maintain this constant, predictable speed of movement, by avoiding slippage at the rollers 28, 30 or by detecting such slippage and taking corrective action.

Although FIG. 2 shows springs associated with the storage drum 18 and the supply drums 20, 22, it would be possible to use springs associated with the supply drums only or the storage drum only, although in such arrangements a constant speed of movement of the strips 24, 26 may be more difficult to achieve. Where springs are associated with only the supply drums they would need to be sufficiently expansive to compensate for the change in speed of both the supply drums and the storage drum. It would be possible to associate a single spring with the storage drum only, if the supply drums behaved symmetrically with each other (for example, if coupled using a differential gear). Otherwise, the strips would be wound onto and unwound from the supply drums unevenly.

Reference has been made to spiral or torsional springs but other types of biasing means could be used, as required. The purpose of the springs is to allow relative rotational movement between the drums and their respective gears or coupling means whilst biasing the drums in a direction to cause the strips to be held tightly.

In FIGS. 1 and 2, two strips 24, 26 are used but it would be possible to use a single strip which would be wound around a storage drum and a single supply drum. Banknotes would then be stored between windings on the storage drum rather than between separate strips on the storage drum as shown. Where a single strip is used, it would be possible to incorporate biasing means with either the storage drum, supply drum or preferably both.

Figure 4:
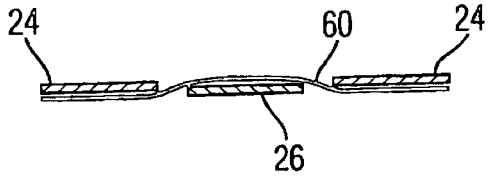
FIG. 4 is a cross-sectional view of modified strips of a banknote store.

In a modification of the illustrated embodiment shown in FIG. 4, strips 24, 26 do not overlap. Two strips 24 are wound around the storage drum and a first supply drum. The other strip 26 is wound around the storage drum and a second supply drum. When the strips 24, 24, 26 are wound around the storage drum, they do not overlap. The banknote 60 is supported between the strips, with strips 24, 24 on one side thereof and strip 26 on the other side thereof. This has the advantage that two windings of the modified strips have approximately the same radial thickness as a single winding of strips 24, 26 as illustrated in FIG. 4. With the reduced thickness, the amount of extension and retraction required to be performed by the biasing means is reduced, since the maximum change in thickness during operation of the storage drum for a given number of banknotes is less. This achieves a more compact design or alternatively means that more banknotes can be stored on a drum of the same approximate size, the governing factor being concerned more with the thickness of the banknotes and less so with the thickness of the strips.

The arrangements described above could be modified by supplying a positive driving force to the various drums, for example using a gear 42 shown in broken lines in FIG. 2 to transmit the rotation produced by the motor 38 to the gears 44, 46 and 50. Alternatively, a separate motor could be provided. However, it is preferred that the speeds of rotation of the drums be controlled by the rate at which the support strips 24, 26 are fed.

Instead of the gears shown schematically in FIG. 2, other arrangements, such as belts, could be used for coupling together the shafts of the various drums.

Instead of storing the banknotes on one drum only, the arrangement could enable transferring of banknotes from one drum to another.

What is claimed is:

1. A banknote store comprising:

first and second winding means mounted for rotation about respective axes on, respectively, first and second shafts;

an elongate support member which can be unwound from one of the winding means onto the other of the winding means, and vice versa, such that banknotes can be supported in succession by the support member while that is wound around at least one of the winding means;

coupling means for coupling the shafts together; and first biasing means between the coupling means and the first winding means and second biasing means between the coupling means and the second winding means for allowing biased relative motion between each said winding means and said coupling means, and for maintaining tension in the support member.

2. A banknote store as claimed in claim 1, arranged such that the biasing force produced by each said biasing means first decreases and then increases as the elongate support member is unwound from either said winding means.

3. A banknote store as claimed in claim 1 or claim 2, arranged such that the biasing means provided between the first winding means and the first driving means produces a tension in said elongate support member which changes in substantially the same manner as the tension produced by the biasing means provided between the second winding means and the second driving means.

4. A banknote store as claimed in claim 1, including means for driving the elongate support member at a substantially constant speed in order to transfer the elongate support members between the first and second winding means.

5. A banknote store as claimed in claim 1, comprising a further elongate support member, the support members being arranged so that they can be unwound from respective second winding means onto the first winding means, and vice versa, such that banknotes can be supported in succession between the elongate support members while they are wound around the first winding means.

6. A banknote store as claimed in claim 5, wherein second biasing means are provided between the coupling means and each said second winding means.

7. A banknote store as claimed in claim 5 or 6, wherein each elongate support member is arranged such that it is in a non-overlapping relationship with the other elongate support member when wound onto the first winding means.

8. A banknote store as claimed in claim 1, wherein said biasing means comprise spiral or torsional springs.

9. A banknote store as claimed in claim 1, wherein each said biasing means is preloaded to provide at least a minimum biasing force as the elongate support member is transferred between winding means.

* * * * *